US010040208B2

(12) United States Patent
Darwinkel et al.

(10) Patent No.: US 10,040,208 B2
(45) Date of Patent: Aug. 7, 2018

(54) ADJUSTABLE SPACING COMB, ADJUSTMENT DRIVE AND HAIR CUTTING APPLIANCE

(71) Applicant: KONINKLIJKE PHILIPS N.V., Eindhoven (NL)

(72) Inventors: Geert-Jan Darwinkel, Eindhoven (NL); Cornelis Johannes Zandsteeg, Eindhoven (NL); Nicky Lewis, Eindhoven (NL); Matthew Gerard Nayna, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/308,178

(22) PCT Filed: Apr. 28, 2015

(86) PCT No.: PCT/EP2015/059111
§ 371 (c)(1),
(2) Date: Nov. 1, 2016

(87) PCT Pub. No.: WO2015/169633
PCT Pub. Date: Nov. 12, 2015

(65) Prior Publication Data

US 2017/0057105 A1 Mar. 2, 2017

(30) Foreign Application Priority Data

May 9, 2014 (EP) ..... 14167685

(51) Int. Cl.
*B26B 19/20* (2006.01)
*B26B 19/38* (2006.01)

(52) U.S. Cl.
CPC ..... *B26B 19/20* (2013.01); *B26B 19/388* (2013.01); *B26B 19/3813* (2013.01); *B26B 19/3886* (2013.01)

(58) Field of Classification Search
CPC ... B26B 19/20; B26B 19/3886; B26B 19/388; B26B 19/3813
See application file for complete search history.

(56) References Cited

U.S. PATENT DOCUMENTS 4,776,095 A 10/1988 Tsujimoto et al.
5,979,060 A * 11/1999 Holzbauer ..... B26B 19/20 30/200

(Continued)

FOREIGN PATENT DOCUMENTS

| | | |
|---|---|---|
| DE | 3800966 A1 | 7/1989 |
| EP | 2581180 A1 | 4/2013 |
| EP | 2610039 A1 | 7/2013 |

OTHER PUBLICATIONS

English translation of EP 2581180 (date of publication: Apr. 2013), translation printed on Oct. 2017.*

*Primary Examiner* — Hwei C Payer

(57) ABSTRACT

An adjustment drive for an adjustable spacing comb for a hair cutting appliance includes an actuator configured to actuate a movable comb portion of the adjustable spacing comb with respect to a blade set of the hair cutting appliance, and a drivetrain for coupling the actuator and the movable comb portion. The drivetrain includes a reduction gear unit and a location detection unit having a rotary encoder which is coupled to an output shaft of the reduction gear unit.

20 Claims, 4 Drawing Sheets

(56) References Cited

U.S. PATENT DOCUMENTS

| | | | | |
|---|---|---|---|---|
| 6,578,269 | B2 * | 6/2003 | Wilcox | B26B 19/20 30/201 |
| 6,968,623 | B2 | 11/2005 | Braun | |
| 7,100,286 | B2 * | 9/2006 | Nakakura | B26B 19/20 30/201 |
| 7,509,743 | B2 * | 3/2009 | Oh | B26B 19/06 30/200 |
| 7,992,307 | B2 | 8/2011 | Smal | |
| 8,844,142 | B2 * | 9/2014 | Kammer | B26B 19/3846 30/201 |
| 8,938,884 | B2 * | 1/2015 | Kammer | B26B 19/3853 30/201 |
| 2012/0233865 | A1 | 9/2012 | Kammer | |
| 2017/0057105 | A1 * | 3/2017 | Darwinkel | B26B 19/20 |
| 2017/0072577 | A1 * | 3/2017 | Darwinkel | B26B 19/20 |
| 2017/0305020 | A1 * | 10/2017 | Darwinkel | B26B 19/20 |

* cited by examiner

ADJUSTABLE SPACING COMB, ADJUSTMENT DRIVE AND HAIR CUTTING APPLIANCE

This application is the U.S. National Phase application under 35 U.S.C. § 371 of International Application No. PCT/EP2015/059111, filed on Apr. 28, 2015, which claims the benefit of International Application No. 14167685.8 filed on May 9, 2014. These applications are hereby incorporated by reference herein.

FIELD OF THE INVENTION

The present disclosure relates to an adjustment drive for an adjustable spacing comb for a hair cutting appliance, wherein the adjustment drive comprises an actuator that is configured for actuating a movable comb portion of the adjustable spacing comb with respect to a blade set of the hair cutting appliance, and a drivetrain for coupling the actuator and the movable comb portion, wherein the drivetrain comprises a reduction gear unit. The present invention further relates to an adjustable spacing comb comprising such an adjustment drive and to a hair cutting appliance that comprises such an adjustable spacing comb.

BACKGROUND OF THE INVENTION

Hair cutting appliances, particularly electric hair cutting appliances, are generally known and may include trimmers, clippers and shavers. Electric hair cutting appliances may also be referred to as electrically powered hair cutting appliances. Electric hair cutting appliances may be powered by electric supply mains and/or by energy storages, such as batteries, for instance. Electric hair cutting appliances are generally used to trim or cut (human) body hair, in particular facial hair and head hair to allow a person to have a well-groomed and well-styled appearance. Frequently, electric hair cutting appliances are also used for cutting animal hair.

U.S. Pat. No. 6,968,623 B2 discloses a hair trimmer comprising an adjustable comb, the hair trimmer further comprising a body, a cutting head including a blade set, wherein the comb is movable with respect to the blade set, an electric motor for driving the blade set to effect a cutting action, and an actuator assembly that is capable of moving the comb with respect to the blade set between a fully retracted position and a fully extended position, the actuator assembly comprising a comb carriage, a comb button connected to the comb carriage, wherein the comb button is actuable to adjust the position of the comb relative to the blade set, and a lock button that is movable with respect to the comb button, wherein the lock button selectively prevents and permits movement of the comb button relative to the body. Consequently, manual adjustment of the length of the comb is enabled.

U.S. Pat. No. 7,992,307 B2 discloses a hair clipper comprising a housing and a motor which is connected by a shaft to a motorized cutting guide, wherein the cutting guide is driven by the motor, wherein the cutting guide is movable to a plurality of guide positions. Consequently, motorized adjustment of the length of the cutting guide (or comb) is enabled.

A comb for a hair cutting appliance, particularly a spacing comb, may be generally arranged as an attachable comb or an integrally formed comb. A spacing comb generally spaces a blade set of the hair cutting appliance from the skin when the appliance is moved in a moving direction with respect to the skin during operation. Consequently, the spacing comb may enable to cut hair to a desired length, i.e. to a desired length of remaining hair at the skin.

Conventional hair cutting appliances may be fitted with a set of attachment combs, each of which is associated with a distinct hair length. Consequently, a user of the appliance basically needs to replace an attachment comb by another one to alter the hair length. Furthermore, manually adjustable comb attachments are known, as disclosed in U.S. Pat. No. 6,968,623 B2. Furthermore, also motorized or powered adjustment combs have been presented in recent years, as disclosed in U.S. Pat. No. 7,992,307 B2. Typically, powered adjustment combs comprise a movable comb portion that is movable with respect to the blade set of the hair cutting appliance, wherein the movable comb portion is coupled to an actuator, particularly to an electromotor and/or electric powertrain.

However, operating a motorized adjustment comb frequently has proven to be afflicted with several drawbacks. A motorized powertrain may, for instance, comprise a control unit that is capable of controlling the actuator (or motor). However, the control unit needs to be provided with respective input information, in particular with respect to an actual state or position of a movable comb portion with respect to the blade set. In other words, it may be desired to provide the control unit with absolute and/or relative (or incremental) positional information. The positional information may be indicative of an actual position of the movable comb portion. Based on the actual position, the control unit may operate the actuator for moving the movable comb portion to a desired destination position.

There are several approaches to the detection of the position or location of the movable comb portion of the adjustable spacing comb. Direct location detection may include sensors that are capable of directly detecting the (translatory) position of the movable comb portion. Consequently, these direct detection sensors basically need to be implemented in addition to and separate from a motorized powertrain for the spacing comb. Consequently, implementing a direct detection sensor that is capable of directly detecting a (translational) position of the spacing comb with respect to the blade set may be costly. An alternative approach may include the detection of rotations or revolutions of the actuator. With respect to the detection of the (true) position of the spacing comb with respect to the blade set, this approach may be referred to as indirect location detection, since a detected signal (e.g. number of rotations or amount of angular movement) needs to be converted into a desired (longitudinal) value. Consequently, the indirect detection approach may be afflicted with several drawbacks, for instance relatively large deviations between a derived (or calculated) positional value and a real positional value.

If the control unit is not aware of the actual position of the movable spacing comb, operating and adjusting the spacing comb may be further complicated. It would be therefore advantageous to present an adjustment drive for an adjustable spacing comb that comprises an improved location detection unit which may address at least some of the above-mentioned drawbacks. It would be further advantageous to provide an adjustable spacing comb and a hair cutting appliance fitted with such an adjustable spacing comb that may exhibit an improved location detection and comb adjustment performance. Preferably, the adjustment drive may be operated and controlled in a highly accurate and precise manner.

There is thus still room for improvement.

SUMMARY OF THE INVENTION

It is an object of the present invention to provide a hair cutting appliance, an adjustable spacing comb for a hair cutting appliance, and an adjustment drive for such an adjustable spacing comb that may overcome at least some of the above-mentioned problems. In particular, it is an object to provide an adjustment drive for an adjustable spacing comb that may ensure precise and accurate position detection and, as a consequence, precise and accurate positioning performance which may particularly include an improved positioning repeatability or reproducibility.

According to a first aspect of the present disclosure, an adjustment drive for an adjustable spacing comb for a hair cutting appliance is presented, the adjustment drive comprising:

- an actuator that is configured for actuating a movable comb portion of the adjustable spacing comb with respect to a blade set of the hair cutting appliance,
- a drivetrain that is configured for coupling the actuator and the movable comb portion, wherein the drive train comprises a reduction gear unit, and
- a location detection unit comprising an encoder, particularly a rotary encoder, wherein the encoder is coupled to an output shaft of the reduction gear unit.

This aspect is based on the insight that a location signal may be detected in a relatively cost-efficient end, at the same time, precise manner at the output shaft of the reduction gear unit. Generally, a drive train including a reduction gear unit may be provided between the actuator and the movable comb portion. Typically, the reduction gear unit is required for converting the relatively high (rotation) speed of the actuator into a desired relatively low (longitudinal) adjustment speed of the movable comb portion. Generally, the actuator may be embodied by an electromotor, particularly by a high-speed or high-rev electromotor. It may be therefore required to provide a reduction gear unit that comprises at least one, preferably a plurality of, reduction gear stages. Consequently, a high-speed and low-torque motion provided by the actuator may be converted into a low-speed and high-torque or high-force motion for adjusting the spacing comb.

Concerning precision and accuracy of the location detection, each stage of the reduction gear may be regarded as a source of error or a source of deviation. This may particularly apply when a low-cost reduction unit is implemented. A low-cost reduction gear unit may comprise at least one low-cost gear wheel. By way of example, a low-cost gear wheel may be obtained from a molding process or a casting process. For instance, at least one gear wheel of the reduction gear unit may be formed from plastic material.

Consequently, relatively large tolerances have to be accepted at the reduction gear unit. Typically, tolerances at the reduction gear unit may have only minor influence on the torque or force conversion and transmission, respectively. However, with respect to the precision of the transmission or conversion of the (angular) movement, tolerances, particularly gearing tolerances, may have a major influence.

In accordance with the above aspect, it is therefore proposed to couple the location detection unit, particularly the encoder thereof, to the output shaft of the reduction gear unit. Consequently, the above aspect may be regarded as a beneficial trade-off between the direct location detection approach and the indirect location detection approach as mentioned above. Tolerances of the gear stage(s) of the reduction gear unit may have only minor influence on the detected position values.

Generally, the actuator may be operated on the basis of the detected location values. Furthermore, an indicator unit may be provided at the hair cutting appliance or at the adjustable spacing comb that may indicate an actual position of the movable comb portion to a user. To this end, visual indicators may be utilized, for instance LCD-displays, LED-displays, distinct LED-elements etc. Generally, the location detection unit may be configured to generate or output a location or position signal that may be transmitted to a control unit and/or a display unit of the hair cutting appliance.

Generally, the location detection unit, particularly the encoder thereof, may be coupled to the drivetrain of the adjustment drive at a "downstream" position thereof. This may involve that the encoder does not necessarily have to be coupled to the very last gear stage of the reduction gear unit. By way of example, the output shaft to which the encoder is coupled may be arranged to engage a further element, for instance a gear wheel at a translatory movement element that is arranged at or coupled to the adjustable spacing comb. It is generally preferred to couple the encoder to a more downstream, preferably the most downstream rotational gear stage of the adjustment drive. It is generally preferred that the encoder of the location detection unit is a rotary encoder that is capable of detecting rotations of an encoder shaft with respect to a location reference, e.g. an encoder housing.

In one embodiment of the adjustment drive, the actuator is a high-speed electromotor, wherein the reduction gear unit comprises at least one reduction gear stage, particularly at least one backlash-afflicted gear stage. Conventional gear stages, particularly low-cost gear stages, may generally exhibit a certain amount of backlash. Reducing or eliminating the gear backlash typically requires relatively costly measures. By coupling the encoder of the location detection unit to the output shaft of the reduction gear unit, any (or at least a substantial portion of) backlash within the reduction gear unit may be circumvented. Any backlash in the reduction gear unit does not influence the location detection accuracy and precision. Typically, the reduction gear unit may be regarded as a multi-stage gear unit comprising two, three, four or even more reduction gear stages. Consequently, tolerances and/or gear backlash of any stage would add up to a total gear tolerance or gear backlash. It is therefore beneficial not to rely on angular motion or position detection at the level of the actuator, for instance by coupling a respective detector or encoder to an output shaft of the actuator.

In yet another embodiment, the output shaft of the reduction gear unit comprises a first toothed section and a second toothed section, wherein the first toothed section is arranged to be coupled with the movable comb portion, and wherein the second toothed section is arranged to be coupled with the encoder. Both the first toothed section and the second toothed section of the output shaft may form an output portion thereof. Consequently, the encoder may comprise an encoder input shaft that comprises at least one detector gear wheel that is arranged to be coupled with or to engage the second toothed section of the output shaft of the reduction gear unit. In accordance with this embodiment, the output shaft may be capable of driving both the movable comb portion and the (input shaft of the) encoder.

According to still another embodiment of the adjustment drive, the output shaft of the reduction gear unit is arranged to be coupled with a translatory movement element for driving the movable comb portion, particularly a translation screw element or a toothed rag element. In other words, the translatory movement element may be arranged as a lead screw or a threaded spindle, particularly a small pitch spindle. Generally, the translatory movement element may be configured for engagement, particularly meshed engagement, with a respective toothed section of the output shaft of the reduction gear unit. To this end, the translatory movement element may comprise a toothed gear wheel or a toothed gear portion.

It may be further preferred in this context that the translatory movement element comprises a main extension direction that is inclined with respect to a longitudinal extension direction of the output shaft. Generally, an adjustment motion direction of the adjustable spacing comb may be inclined with respect to a general longitudinal elongation direction of a housing portion of the hair cutting appliance. Consequently, it may be preferred that also the translatory movement element and the reduction gear unit and/or the actuator are inclined with respect to each other. Thus, an output shaft of the actuator and the output shaft of the reduction gear unit may be substantially parallel, at least in some embodiments.

It may be therefore further preferred that the output shaft of the reduction gear unit comprises a crown gear or bevel gear section and a spur gear section, wherein the crown gear or bevel gear section is arranged to be coupled with the movable comb portion, and wherein the spur gear section is arranged to be coupled with the encoder. This embodiment may be further developed in that the crown gear or bevel gear section and the spur gear section are arranged to engage their respective counterpart gear sections that are associated with the movable comb portion and the encoder with low backlash, particularly low rotational backlash.

At the translatory movement element that is coupled to the movable comb portion, a respective bevel gear section may be provided that is arranged to engage the crown gear or bevel gear section of the output shaft. At the input or detector shaft of the encoder, a spur gear section may be provided that is arranged to engage the spur gear section of the output shaft. Consequently, the output shaft and the detector shaft may be basically parallel to each other.

In still another embodiment of the adjustment drive, the location detection unit further comprises a detector shaft that is arranged between the output shaft and the encoder. As already indicated above, the detector shaft may comprise a toothed section that is arranged to engage a counterpart toothed section at the output shaft of the reduction gear unit.

In yet another embodiment of the adjustment drive, the encoder is a high resolution rotary encoder. Preferably, the encoder is capable of detecting angular signals at a minimum angular resolution of at least 9° (degrees). More preferably, the encoder is capable of detecting angular signals at a minimum angular resolution of at least 5°. Consequently, an actual position of the movable comb portion may be precisely detected, even though the encoder is not directly coupled to the movable comb portion.

Generally, the encoder may be configured to detect angular motion, angular velocity and/or angular acceleration. Consequently, positioning speed, positioning distance, target positions, etc. may be detected. Generally, the encoder may be configured to output an electric signal that may take the form of an analog signal or a digital signal. The encoder may be arranged as an absolute encoder or an incremental encoder. The encoder may be arranged as an optical encoder and/or a capacitive encoder, for instance.

By way of example, when the encoder is arranged as an absolute encoder, a distinct turning angle of the output shaft may be associated with a distinct absolute position of the movable comb portion with respect to the blade set. It is worth mentioning in this regard that the encoder may be arranged as a single-turn encoder or a multi-turn encoder.

In yet another embodiment, the encoder may be arranged as an incremental encoder. In other words, the encoder may be arranged as a relative encoder. An incremental encoder may be configured to detect incremental (rotational) position changes of output shaft. Consequently, incremental position changes of the movable comb portion may be detected accordingly. It goes without saying that also a combination of absolute and incremental rotary motion detection may be utilized by the encoder and a respective control unit.

In still another embodiment, the adjustment drive further comprises a control unit that is coupled to the actuator and to the encoder, wherein the control unit is arranged to operate the actuator on the basis of location signals that represent an actual position of the movable comb portion detected by the location detection unit. Consequently, a target position for the movable comb portion may be defined on the basis of accurately detected actual position values. Tolerances and/or gearing backlash have no major influence on the operating and controlling precision.

The above embodiment may be further detailed in that the control unit is capable of operating the adjustment drive such that the movable comb portion is precisely adjustable, wherein achieved minimum incremental length adjustment steps are in the range of about 0.1 mm to about 0.5 mm (millimeter). In other words, the adjustment drive may be regarded as an accurate adjustment drive providing high precision position detection and adjustment of the movable comb portion. Furthermore, the adjustment drive may enable repeatable and/or reproducible measurements and adjustment operations.

It is further preferred in this context that the adjustment drive is capable of adjusting the movable comb portion with high overall repeatability, wherein overall length adjustment repeatability is in a range of about 0.1 mm to about 0.5 mm.

In yet another embodiment, the reduction gear unit is a low cost reduction gear unit, wherein at least some gear wheels or gears of the reduction gear unit are at least partially made from plastic material. For instance, the gears may be formed by injection molding. Generally, the gears may be formed by a molding process. Molding may include injection molding, die cast molding (of metal material) and sintering (of metal material). Low cost gears may also be obtained from metal cutting processes, particularly from finish blanking processes.

According to another aspect of the present disclosure, an adjustable spacing comb for a hair cutting appliance is presented, wherein the adjustable spacing comb comprises a movable comb portion that is movable with respect to a housing portion of the hair cutting appliance, and an adjustment drive in accordance with at least some embodiments of the present disclosure. The movable comb portion may comprise a plurality of comb teeth that may divide and guide hairs when the hair cutting appliance including the adjustable spacing comb is moved through hair to cut hair to a selected length. Generally, the adjustable spacing comb may be arranged as an attachable and detachable spacing comb that may be attached to and released from the housing portion of the hair cutting appliance, if required. In the alternative, the adjustable spacing comb may be arranged as an integrally provided spacing comb that forms an integrated part of the hair cutting appliance. In other words, such an integrated adjustable spacing comb may not be removed or released from the housing portion of the hair cutting appliance.

According to yet another aspect of the present disclosure, a hair cutting appliance, particularly a hair trimmer or clipper, is presented, wherein the hair cutting appliance comprises a housing portion, a cutting unit including a blade set, and an adjustable spacing comb in accordance with at least some embodiments of the present disclosure. Generally, the hair cutting appliance may be regarded as an electrically powered hair cutting appliance. Consequently, a motor may be provided for driving the blade set. Typically, the blade set may comprise a stationary blade and a movable blade, wherein the movable blade is movable with respect to the stationary blade. The movable blade may be driven with respect to the stationary blade, particularly oscillatingly driven. The movable blade and the respective stationary blade may comprise cutting edges that may cooperate to cut hair.

Generally, the hair cutting appliance may comprise an elongated housing comprising a first end and a second end which is opposite to the first end. At the first end of the housing, a cutting head may be arranged. The second end of the housing may also be referred to as handle end.

BRIEF DESCRIPTION OF THE DRAWINGS

These and other aspects of the disclosure will be apparent from and elucidated with reference to the embodiments described hereinafter. In the following drawings

DETAILED DESCRIPTION OF EMBODIMENTS

Figure 1:
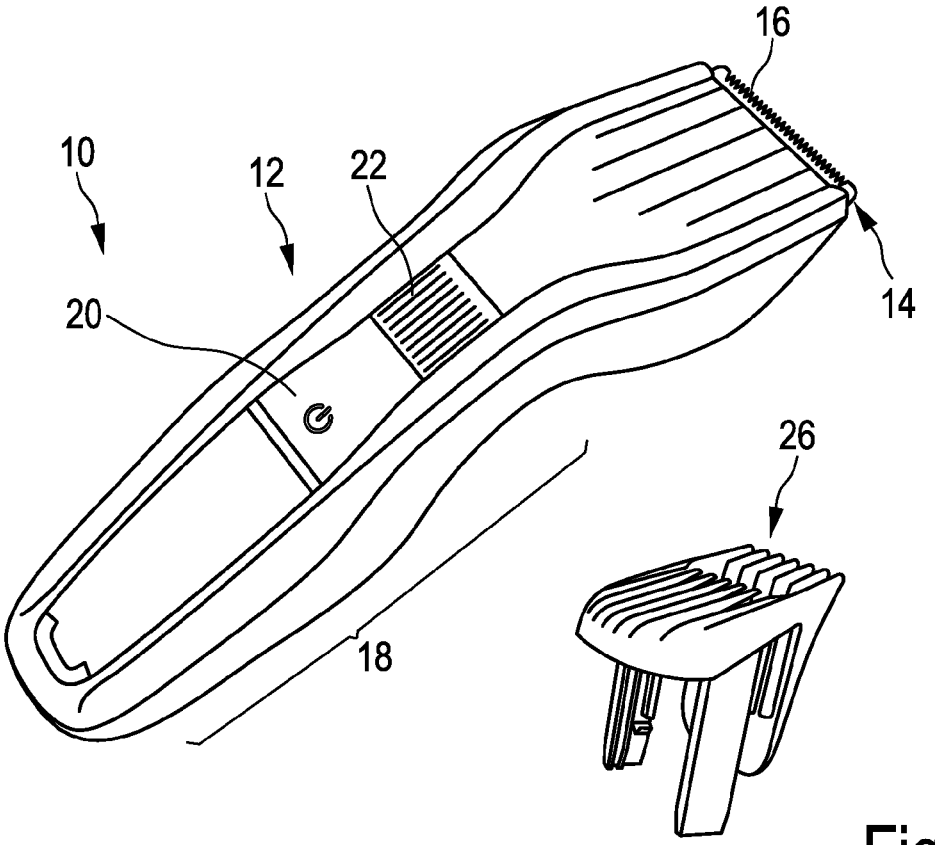
FIG. 1 shows a schematic perspective view of an exemplary electric hair cutting appliance and an adjustable spacing comb for the hair cutting appliance, wherein the spacing comb is shown in a detached state.

FIG. 1 shows a schematic perspective view of a hair cutting appliance 10, particularly an electrically-operated hair cutting appliance 10. The hair cutting appliance 10 may also be referred to as hair clipper or hair trimmer. The hair cutting appliance 10 may comprise a housing or housing portion 12 having a generally elongated shape. At a first end thereof, a cutting unit 14 may be provided. The cutting unit 14 may comprise a blade set 16. The blade set 16 may comprise a movable blade and a stationary blade that may be moved with respect to each other to cut hair. At a second end of the housing portion 12, a handle or grip portion 18 may be provided. A user may grasp or grab the housing at the grip portion 18.

The hair cutting appliance 10 may further comprise operator controls. For instance, an on-off switch or button 20 may be provided. Furthermore, a length adjustment control 22 may be provided at the housing 12 of the hair cutting appliance 10. The length adjustment control 22 may be provided in case an adjustable spacing comb 26 is attached to the housing portion 12 of the hair cutting appliance 10. In FIG. 1, the adjustable spacing comb 26 is shown in a detached or released state. When the spacing comb 26 is detached from the hair cutting appliance 10, a minimum cutting length may be achieved. When the spacing comb 26 is attached to the hair cutting appliance 10, hairs can be cut to a desired length.

Figure 2:
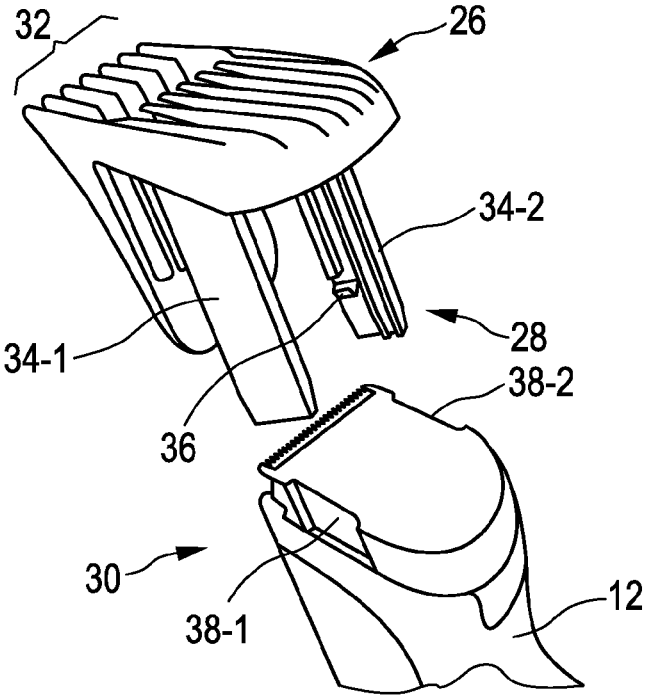
FIG. 2 shows a partial exploded perspective view of another embodiment of a hair cutting appliance and an adjustable spacing comb, wherein the spacing comb is shown in an insertion orientation.

FIG. 2 shows a partial perspective schematic illustration of a first end of a housing portion 12 of a hair cutting appliance 10. Furthermore, an adjustable spacing comb 26 is shown in an insertion orientation with respect to the housing portion 12. The housing portion 12 and the adjustable spacing comb 26 are shown in an exploded state. By way of example, the spacing comb 26 may comprise an attachment portion 28 which may comprise, for instance, sliding beams 34-1, 34-2. The attachment portion 28 may engage the housing portion 12. More particularly, the attachment portion 28 may be attached to a mounting portion 30 of the housing portion 12. To this end, the sliding beams 34-1, 34-2 may be inserted into respective mounting slots 38-1, 38-2 at the mounting portion 30. The attachment portion 28 may further comprise at least one snap-on member 36 which may be provided at at least one of the sliding beams 34-1, 34-2, for instance. The snap-on member 36 may secure the spacing comb 26 in its mounted state.

As can be further seen from FIG. 2, the spacing comb 26 may further comprise a toothed portion 32 including a plurality of comb teeth. Generally, the toothed portion 32 may comprise a slot in which the blade set 16 can be arranged in the attached state.

Figure 3:
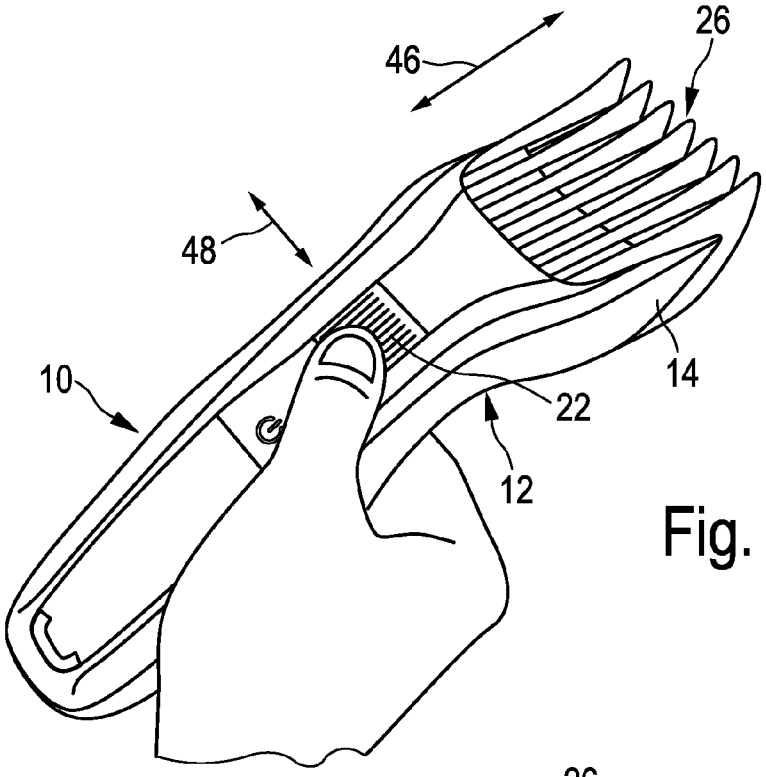
FIG. 3 is a schematic perspective view of yet another embodiment of a hair cutting appliance fitted with an adjustable comb, the hair cutting appliance being held by a user that may operate a control element for comb length adjustment.
Figure 4:
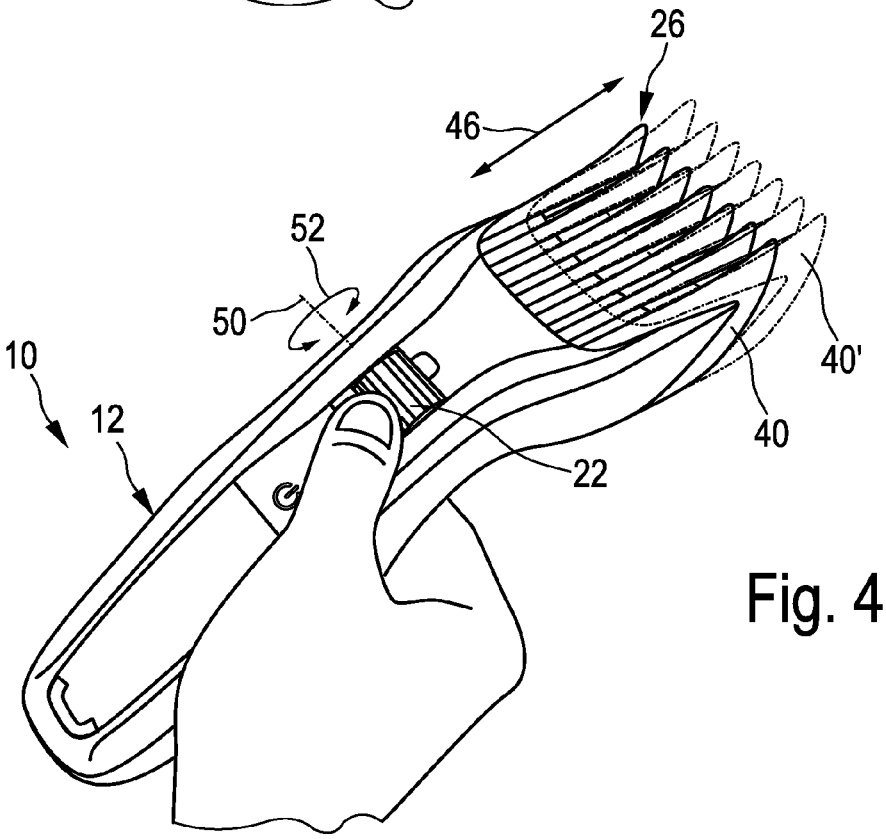
FIG. 4 is a schematic perspective view of yet another embodiment of a hair cutting appliance fitted with an adjustable spacing comb, the hair cutting appliance being held by a user that may operate a control element for operating an adjustment drive for the spacing comb, wherein the control element is different from a respective control element shown in FIG. 3.

With further reference to FIG. 3 and FIG. 4, exemplary embodiments of the hair cutting appliances 10 are illustrated that are fitted with a respective adjustable spacing comb 26. FIG. 3 and FIG. 4 show perspective views of hair cutting appliances 10 in a state held by a user. The hair cutting appliances 10 may further comprise an adjustment drive for the adjustable spacing comb 26 (not shown in FIG. 3 and FIG. 4). The user may actuate the adjustment drive by operating the length adjustment control 22.

Generally, the adjustable spacing comb 26 or, more particularly, a movable comb portion 40 (refer to FIG. 4) thereof may be moved with respect to the blade set 16 of the hair cutting appliance 10 (refer to FIG. 1) to adjust a distance between the adjustable spacing comb 26 and the blade set 16. By way of example, the movable spacing comb 26 may be extended or retracted in a generally longitudinal direction indicated in FIG. 3 and FIG. 4 by a double-arrow denoted by reference numeral 46. The spacing comb 26 shown in FIG. 3 is in a retracted state. FIG. 4 illustrates a refracted end and an extended state of the movable comb portion 40 of the spacing comb 26. A respective extended state of the movable comb portion 40' is indicated in FIG. 4 by dashed lines.

As can be seen in FIG. 3, the user may actuate the length adjustment control 22 in a basically lateral direction to cause an adjustment movement of the spacing comb 26. A double arrow denoted by reference numeral 48 indicates the lateral operating direction. FIG. 4 illustrates a differently shaped length adjustment control 22. By way of example, the length adjustment control 22 may be rotatingly arranged at the housing portion 12 of the hair cutting appliance 10. Consequently, the user may rotate or swivel the length adjustment control 22 about a rotation axis 50, refer also to a curved double arrow denoted by reference number 52 in FIG. 4. By actuating or operating the length adjustment control 22, the user may control the adjustment drive for the adjustable spacing comb 26 so as to define or set a desired cutting length.

Figure 5:
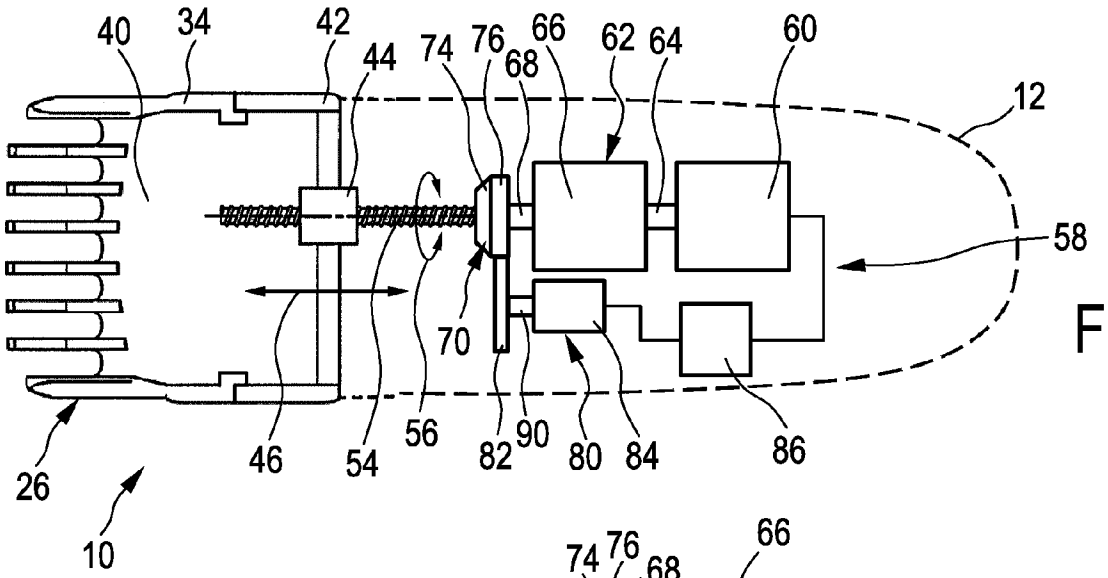
FIG. 5 shows a simplified top view of an embodiment of hair cutting appliance fitted with an adjustable spacing comb and an adjustment drive for the spacing comb.
Figure 6:
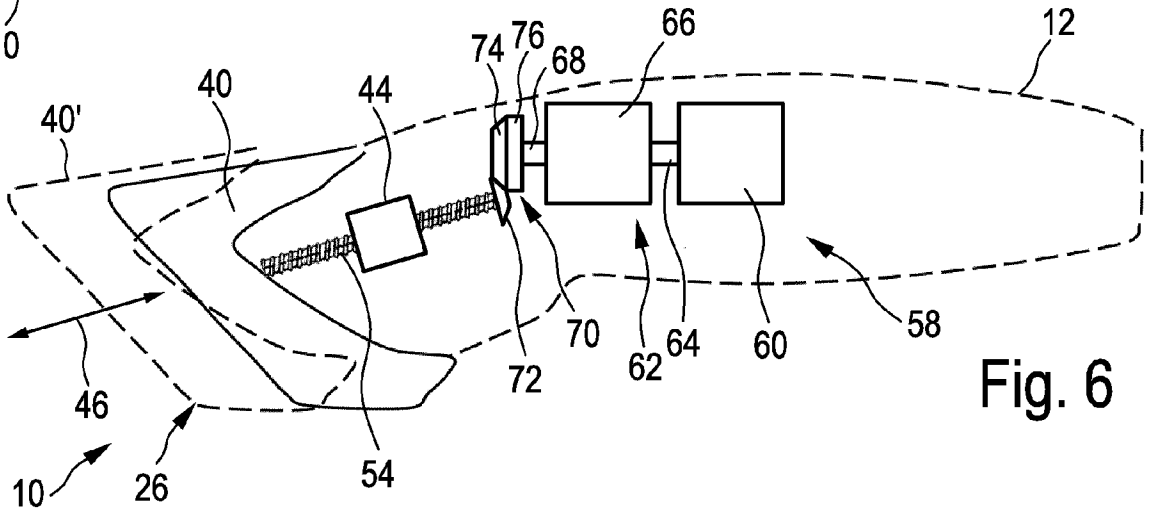
FIG. 6 shows a simplified side view of an embodiment of a hair cutting appliance fitted with a retractable spacing comb and an adjustment drive for adjusting the spacing comb.
Figure 7:
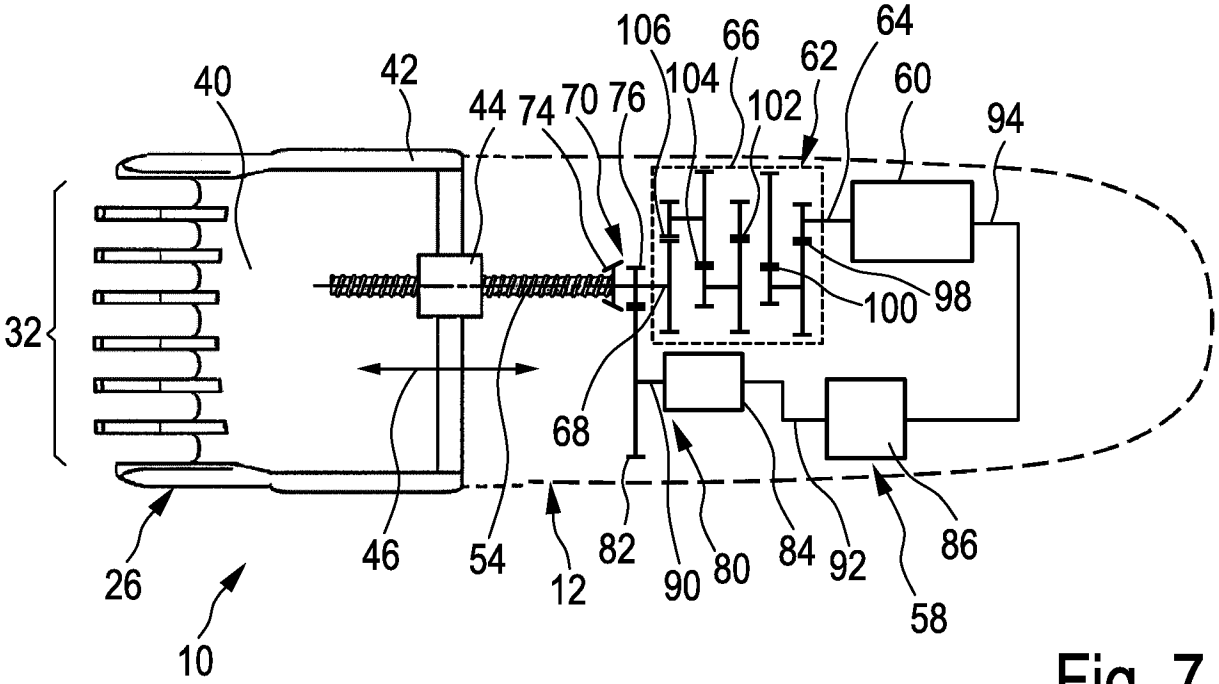
FIG. 7 shows another simplified top view of yet another embodiment of a hair cutting appliance fitted with an adjustable spacing comb and an adjustment drive for the spacing comb.

With further reference to FIGS. 5, 6 and 7, illustrative embodiments of hair cutting appliances 10 that are fitted with adjustment drives for an adjustable spacing comb will be illustrated and further described. In FIGS. 5, 6, and 7, a respective housing portion 12 of the hair cutting appliances 10 is indicated by dashed lines. Consequently, internal components of the hair cutting appliances 10 are visible. Generally, the adjustment drives 58 are at least partially housed in or covered by the housing portion 12.

It is further worth mentioning in this regard that the views shown in FIGS. 5, 6 and 7 do not necessarily represent the same arrangement or embodiment. FIG. 5 shows a schematic top view of a hair cutting appliance 10 fitted with an adjustable spacing comb 26. FIG. 6 shows a schematic side view of a hair cutting appliance 10 fitted with a similar adjustable spacing comb 26, wherein a respective movable comb portion of the spacing comb 26 is shown in FIG. 6 in a retracted state (reference numeral 40) and in an extended state indicated by dashed lines (reference numeral 40'). FIG. 7 shows a further schematic top view of a hair cutting appliance 10 that is fitted with an adjustable spacing comb 26.

With particular reference to FIG. 5, the adjustable spacing comb 26 is further described. The adjustable spacing comb 26, refer also to FIG. 1 and to FIG. 2, may comprise sliding beams 34 that may cooperate with a carriage 42 that is movably arranged at the housing portion 12. Generally, a snap-on mounting of the sliding beams 34 at the carriage 42 may be provided. At least a substantial portion of the spacing comb 26 may be regarded as movable comb portion 40. As can be best seen in FIG. 5, the movable comb portion 40 may be coupled to the carriage 42 and, consequently, moved with the carriage 42. For driving the carriage 42 and the movable comb portion 40, an engagement member 44 may be provided that is coupled to the carriage 42. For driving or operating the movable comb portion 40 with respect to the blade set 16 (or to the housing 12) an adjustment drive 58 may be provided which may also be referred to as adjustment powertrain. In other words, the adjustment drive 58 may be regarded as motorized adjustment drive 58.

The adjustment drive 58 may comprise an actuator 60 or, more particularly, an electromotor. The actuator 60 may be coupled to a drivetrain 62. The drivetrain 62 may comprise a reduction gear unit 66 that is coupled to an actuator output shaft 64. The reduction gear unit 66 may comprise a plurality of gear stages, refer also to FIG. 7. The reduction gear unit 66 may comprise an output shaft 68. At the output shaft 68, a drive gear 70 may be arranged. The drive gear 70 may be coupled to a translatory movement element 54 which is configured to engage the engagement member 44 of the carriage 42. By way of example, the translatory movement element 54 may be arranged as a spindle element or a rack element. Generally, the translatory movement element 54 may be arranged to convert a rotational input motion, shown by curved double arrow 56, applied by the drive gear 70 of the output shaft 68 of the reduction gear unit 66 into a longitudinal adjustment movement of the movable comb portion 40, refer to the double-arrow 46 in FIGS. 5, 6 and 7.

By way of example, the translatory movement element 54 may comprise a driveable gear wheel 72 which may be configured to engage the drive gear 70, refer also to FIG. 6. In some embodiments, the translatory movement element 54 may be inclined with respect to the output shaft 68 of the reduction gear unit 66, as can be also seen from FIG. 6. This may improve the handling of the hair cutting appliance 10 since in this way the housing portion 12 may be shaped in a user-friendly fashion providing a proper ergonomic design. As can be seen from FIG. 6, the overall extension of the housing portion 12 may be slightly curved or banana-shaped.

Generally, the drive gear 70 of the output shaft 68 of the reduction gear unit 66 may be further coupled to a location detection unit 80. Consequently, an actual position of the movable comb portion 40 may be detected at a downstream position of the drivetrain 62. Consequently, gear backlash and/or tolerance effects at the reduction gear unit 66 may only have a minor influence on the detection accuracy. For coupling the output shaft 68 and the location detection unit 80, the drive gear 70 of the output shaft 68 may be arranged to engage both the translatory movement element 54 and the location detection unit 80. To this end, the drive gear 70 may comprise a first toothed section 74 and a second toothed section 76. The first toothed section 74 may be arranged as a bevel gear section. The first toothed section 74 may engage the drivable gear 72. Generally, the drivable gear 72 and the first toothed section 74 may form a bevel gear set which may cover or span an angular offset between the output shaft 68 of the reduction gear unit 66 and the translatory movement element 54.

The drive gear 70 of the reduction gear unit 66 may further comprise a spur gearing arranged at the second toothed section 76. The second toothed section 76 may engage a corresponding detector gear wheel 82 arranged at a detector shaft 90 of the location detection unit, refer also to FIG. 7.

In some embodiments, the adjustment drive 58 may be arranged such that both the drivable gear 72 of the translatory movement element 54 and the detector gear wheel 82 of the detector shaft 90 may engage the same toothed section of the drive gear 70. This may involve an axial overlap between the drivable gear 72 and the detector gear wheel 82. Since the detector gear wheel 82 and the drivable gear 72 basically engage the same drive gear 70, an actual position of the movable comb portion 40 may be nearly directly detected. As with the embodiments shown in FIG. 5, mainly remaining gearing tolerances or a gearing backlash that may occur at respective contact or engagement portions downstream of the reduction gear unit may influence the location detection accuracy.

As can be best seen from FIG. 5 and FIG. 7, the location detection unit 80 may comprise an encoder 84 that may comprise a detector shaft 90 that is rotatable with respect to a stationary detection portion of the encoder 84. The detector gear wheel 82 may be fixedly attached to the detector shaft 90. By way of example, the encoder 84 may comprise a Hall-sensor or a similar customary rotation sensor.

The encoder 84 may generate an output signal that is indicative of an actual position of the movable comb portion 40. The signal may be transferred to a control unit 86. The control unit 86 may process the respective signal. By way of example, the control unit 86 may be further coupled to the length adjustment control 22 illustrated in FIGS. 1, 3 and 4. The control unit 86 may be further coupled to the actuator 60 of the adjustment drive 58. Consequently, the actuator 60 may be operated on the basis of the positional information detected by the location detection unit 80. To this end, respective signal lines 92, 94 may be arranged between the encoder 84, the control unit 86 and the actuator 60, respectively.

FIG. 7 illustrates a further embodiment of an adjustment drive 58 for an adjustable spacing comb 26. More particularly, FIG. 7 further details an exemplary embodiment of a drivetrain 62 of the adjustment drive 58. The reduction gear unit 66 of the drivetrain 62 may arranged as a multi-stage reduction gear unit.

Generally, the actuator 60 may be arranged as a high-speed motor. Consequently, a considerably high gear ratio may be required to convert the high-speed rotational motion of the actuator 60 into a relatively low speed motion of the movable spacing comb which may involve a corresponding force or torque conversion.

As can be seen from FIG. 7, the output shaft or actuator shaft 64 of the actuator 60 may be coupled to a first gear stage 98, particularly a first reduction gear stage. The first gear stage 98 may be coupled to a second gear stage 100. The second gear stage 100 may be coupled to a third gear stage 102. The third gear stage 102 may be coupled to a fourth gear stage 104. The fourth gear stage 104 may be coupled to a fifth gear stage 106. The output shaft 68 of the reduction gear unit 66 may be coupled to the fifth gear stage 106. Each of the gear stages 98, 100, 102, 104, 106 may be arranged as a reduction gear set. It is worth mentioning in this regard that the embodiment of the reduction gear unit 66 shown in FIG. 7 is a rather exemplary embodiment. In other words, different configurations and different numbers of gear stages may be provided at the reduction gear unit 66.

Generally, the reduction gear unit 66 may be arranged as a multi-stage low reduction gear unit. Consequently, at each of the gear stages of the reduction gear unit 66, tolerances and/or gearing backlash may occur. Tolerances and gearing backlash may add up to a total gearing tolerance or backlash value. It is therefore beneficial to couple the location detection unit 80 to the output shaft 68. This may have the further advantage that at least some of the gear stages 98, 100, 102, 104, 106 or, at least, some of the gear wheels thereof may be arranged as low-cost components. Typically, low-cost gearing components are afflicted with significant gearing backlash and/or poor gearing accuracy. Since the location detection unit 80 is coupled to a downstream component of the reduction gear unit 66, these inaccuracies may have no influence on the precision and accuracy of the location detection.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair cutting appliance comprising:
- a housing portion;
- a cutting unit including a blade set;
- an adjustable spacing comb including a movable comb portion that is movable with respect to the housing portion of the hair cutting appliance; and
- an adjustment drive,
- wherein the adjustment drive includes:
- an actuator that is configured for actuating the movable comb portion of the adjustable spacing comb with respect to the blade set of the hair cutting appliance, wherein the actuator is an electromotor;
- a drivetrain that is configured for coupling the actuator and the movable comb portion, wherein the drivetrain comprises a reduction gear unit; and
- a location detection unit comprising a rotary encoder, wherein the rotary encoder is coupled to an output shaft of the reduction gear unit, and wherein the rotary encoder is configured to output an electric signal.

2. The hair cutting appliance as claimed in claim 1, wherein the electromotor is a high-speed electromotor, and wherein the reduction gear unit comprises at least one reduction gear stage.

3. The hair cutting appliance as claimed in claim 1, wherein the output shaft of the reduction gear unit is arranged to be coupled with a translatory movement element for driving the movable comb portion, and wherein the translatory movement element comprises a main extension direction that is inclined with respect to a longitudinal extension direction of the output shaft.

4. The hair cutting appliance as claimed in claim 1, wherein the output shaft of the reduction gear unit comprises a first toothed section and a second toothed section, wherein the first toothed section is arranged to be coupled with the movable comb portion, wherein the second toothed section is arranged to be coupled with the rotary encoder, and the first toothed section comprises a crown gear or bevel gear section and the second toothed section comprises a spur gear section, wherein the crown gear or bevel gear section is arranged to be coupled with the movable comb portion, and wherein the spur gear section is arranged to be coupled with the rotary encoder.

5. An adjustment drive for an adjustable spacing comb for a hair cutting appliance, comprising:
- an actuator that is configured for actuating a movable comb portion of the adjustable spacing comb with respect to a blade set of the hair cutting appliance, wherein the actuator is an electromotor;
- a drivetrain that is configured for coupling the actuator and the movable comb portion, wherein the drivetrain comprises a reduction gear unit; and
- a location detection unit comprising a rotary encoder, wherein the rotary encoder is coupled to an output shaft of the reduction gear unit.

6. The adjustment drive as claimed in claim 5, wherein the electromotor is a high-speed electromotor, and wherein the reduction gear unit comprises at least one reduction gear stage.

7. The adjustment drive as claimed in claim 5, wherein the output shaft of the reduction gear unit comprises a first toothed section and a second toothed section, wherein the first toothed section is arranged to be coupled with the movable comb portion, and wherein the second toothed section is arranged to be coupled with the rotary encoder.

8. The adjustment drive as claimed in claim 7, wherein the first toothed section comprises a crown gear or bevel gear section and the second toothed section comprises a spur gear section, wherein the crown gear or bevel gear section is arranged to be coupled with the movable comb portion, and wherein the spur gear section is arranged to be coupled with the rotary encoder.

9. The adjustment drive as claimed in claim 8, wherein the crown gear or bevel gear section and the spur gear section are arranged to engage their respective counterpart gear sections that are associated with the movable comb portion and the rotary encoder with low-backlash.

10. The adjustment drive as claimed in claim 5, wherein the output shaft of the reduction gear unit is arranged to be coupled with a translatory movement element for driving the movable comb portion.

11. The adjustment drive as claimed in claim 10, wherein the translatory movement element comprises a main extension direction that is inclined with respect to a longitudinal extension direction of the output shaft.

12. The adjustment drive as claimed in claim 5, wherein the location detection unit further comprises a detector shaft that is arranged between the output shaft and the rotary encoder.

13. The adjustment drive as claimed in claim 5, wherein the rotary encoder is a high resolution rotary encoder.

14. The adjustment drive as claimed in claim 5, further comprising a control unit that is coupled to the actuator and to the rotary encoder, wherein the control unit is arranged to operate the actuator on the basis of location signals that represent an actual position of the movable comb portion detected by the location detection unit.

15. The adjustment drive as claimed in claim 14, wherein the control unit is configured to operate the adjustment drive such that the movable comb portion is precisely adjustable, wherein achieved incremental length adjustment steps are in the range of 0.1 mm to 0.5 mm.

16. The adjustment drive as claimed in claim 14, wherein the adjustment drive is configured to adjust the movable comb portion with high overall repeatability, wherein overall length adjustment repeatability is in the range of 0.1 mm to 0.5 mm.

17. The adjustment drive as claimed in claim 5, wherein the reduction gear unit is a low cost reduction gear unit, wherein at least some gears of the reduction gear unit are at least partially made from plastic material.

18. The adjustment drive as claimed in claim 5, wherein the electromotor is a high-speed electromotor, and wherein the reduction gear unit comprises at least one backlash-afflicted gear stage.

19. The adjustment drive as claimed in claim 5, wherein the output shaft of the reduction gear unit is arranged to be coupled with one of a translation screw element and a toothed rack element for driving the movable comb portion.

20. The adjustment drive as claimed in claim 5, wherein the rotary encoder is a rotary encoder configured to detect angular signals at a minimum angular resolution of at least 9°.

* * * * *